United States Patent [19]

Ting

[11] 4,346,538

[45] Aug. 31, 1982

[54] BLOW-IN/BLOW-OUT DOUBLE-SKIN WALL CONSTRUCTION

[76] Inventor: Raymond M. L. Ting, 318 Holiday Dr., Pittsburgh, Pa. 15237

[21] Appl. No.: 167,467

[22] Filed: Jul. 11, 1980

[51] Int. Cl.[3] ..... E04C 2/46; E04B 1/98

[52] U.S. Cl. ..... 52/1; 52/98; 52/232

[58] Field of Search ..... 52/1, 98, 232

[56] References Cited

U.S. PATENT DOCUMENTS 3,998,016 12/1976 Ting ..... 52/1 X 4,050,204 9/1977 Scott ..... 52/1 X 4,094,108 6/1978 Scott ..... 52/1

*Primary Examiner*—Alfred C. Perham

*Attorney, Agent, or Firm*—Harry B. Keck

[57] ABSTRACT

A building wall construction employing liner panels and facing panels. Liner panels are positively secured and releasably secured between adjacent horizontal frame members of the building. Facing panels are positively secured at their mid-region to a horizontal frame member and are positively secured at one end to a liner panel and releasably secured at the other end to a liner panel. The resulting building wall will fail at predictable pressure differentials.

4 Claims, 15 Drawing Figures

FIG.9
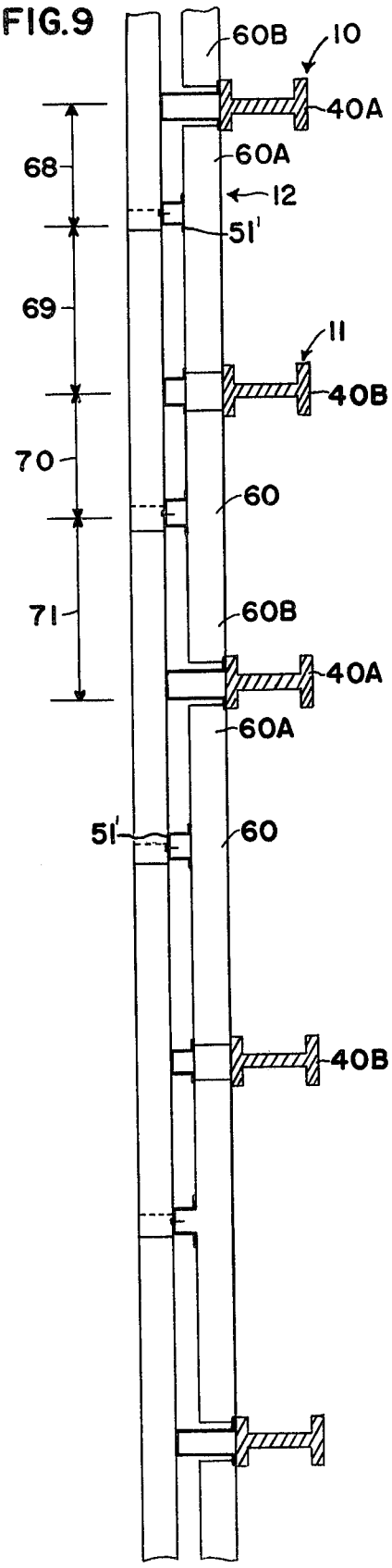
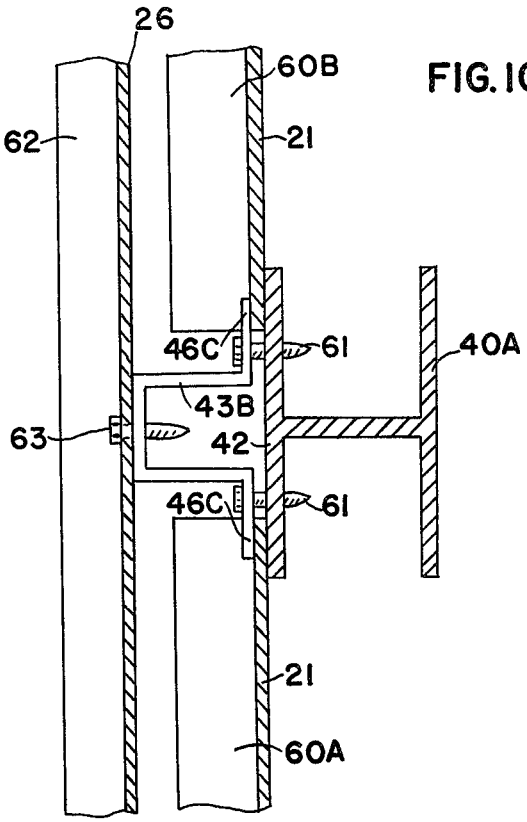
FIG.10
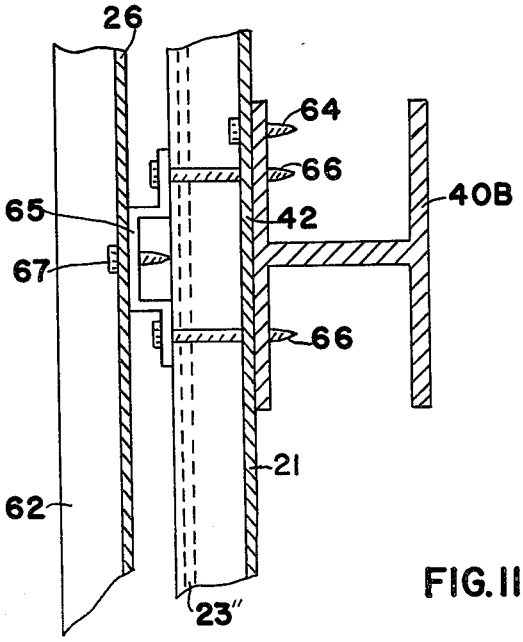
FIG.11

BLOW-IN/BLOW-OUT DOUBLE-SKIN WALL CONSTRUCTION

BACKGROUND OF THE INVENTION

1. Field of the Invention

This invention relates to wall structures for buildings which can be designed to fail when exposed to internal pressures or external pressures exceeding selecting design values.

2. Description of the Prior Art

To protect buildings from excessive destruction, it is a design principle to provide exterior wall constructions which can be sacrificed to save the building framework when abnormally high pressures are developed, for example, explosions within the building; high winds outside the building; explosions outside the building; severe negative wind pressures outside the building.

Where external walls are double-skin construction, i.e., have an inner liner panel surface and an outer facing panel surface with thermal insulation therebetween, an accepted design procedure is described in U.S. Pat. No. 3,998,016 which describes a wall structure for single-span conditions and for double-span conditions. In each instance, the liner panels are secured rigidly to the building framework and have one end for each span which is releasably retained with the building framework. Corresponding facing sheets are secured by means of two different types of subgirts. The first type subgirt is connected to a previously fastened liner panel and to the building framework. The second type subgirt is connected only to a previously installed liner panel. This second type subgirt is spaced apart from the building framework by a predetermined distance which influences the failure threshold for the resulting wall. The facing panels, in these designs, have a one-to-one correspondence with the liner panels, i.e., if the liner panels are single-span, the corresponding facing panels are single-span; similarly if the liner panels are two-span, the facing panels are two-span.

A difficulty which has been encountered with the design of the wall construction of U.S. Pat. No. 3,998,016 is that the failure threshold differs for the wall span having an overlapped facing sheet and the wall span having an overlapping facing sheet. The described difference occurs because the upper span, of a two-span panel assembly, releases at its predicted release load whereas the lower span of the two-span assembly releases at a higher load because of the overlapping facing panel joint. This difference can be overcome by eliminating the panel release interference through the use of a redesigned overlapping joint involving a supplemental profiled filler piece. This technique proved effective but quite costly when actually installed in a building employing the panel design.

SUMMARY OF THE INVENTION

According to the present invention a double-skin wall construction is provided wherein single-span or double-span liner panels are provided. Single-span facing panels are provided which span distances which are offset from the liner panel spans and which extend from the mid-region of one liner panel span to the mid-region of the next liner panel span. Each liner panel is secured to the building framework in a positive manner with respect to each span and is secured to the building framework at one edge in a releasable manner in each span by confinement means.

Each facing panel is secured to the building framework in a positive manner in its mid-region; is secured to an underlying liner panel at its lower end where the lower edge of a facing panel overlaps the subjacent facing panel; and is releasably secured by confinement means at its upper end where it is overlapped by the bottom edge of a superposed facing panel.

Multiple subgirt elements are provided for connecting facing panels with the underlying liner panels.

In a particular refinement of the invention, the failure load of the wall can be predetermined by selecting the location of the releasable securing means for the facing panel within the span where it is positioned.

BRIEF DESCRIPTION OF THE DRAWINGS

FIG. 9 is a sectional view of a building wall construction of this invention in an alternative embodiment.

FIG. 10 is an enlarged cross-sectional view of a joint indicated by the numeral 10 in FIG. 9.

FIG. 11 is a cross-sectional view of a joint indicated by the numeral 11 in FIG. 9.

DESCRIPTION OF THE PREFERRED EMBODIMENTS

Figure 1:
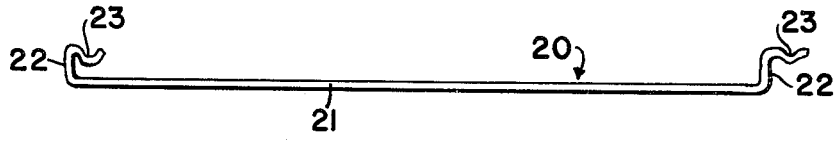
FIG. 1 is an end view of a typical building wall liner panel.

In FIG. 1 a typical liner panel 20 has a generally flat surface 21, perpendicular webs 22 and flanges 23. When the liner panels 20 are assembled in side-by-side relation, the central surface 21 normally is secured to the building framework and the flanges are in overlying engagement.

Figure 2:
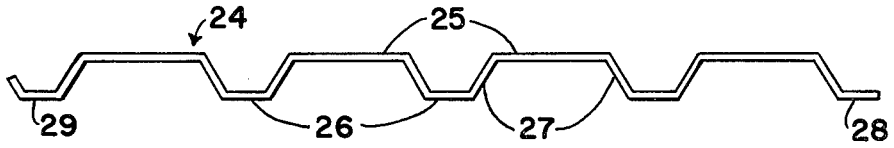
FIG. 2 is an end view of a typical building wall facing panel.

In FIG. 2, a typical facing panel 24 includes crest surfaces 25, valley surfaces 26 and intervening sloping web surfaces 27. Each facing panel 24 includes a lateral valley 28 on one side and a lateral valley 29 on the other side for overlapping side-by-side assembly of multiple facing panels 24.

Figure 3:
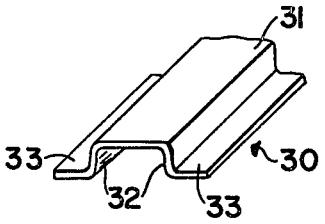
FIG. 3 is a perspective illustration of a typical subgirt which is employed in double-skinned metal building panels.

The liner panels and facing panels customarily are joined by means of subgirts 30, as shown in FIG. 3, having a crest surface 31, web surfaces 32 and outward flanges 33.

PANEL ASSEMBLY

Figure 4:
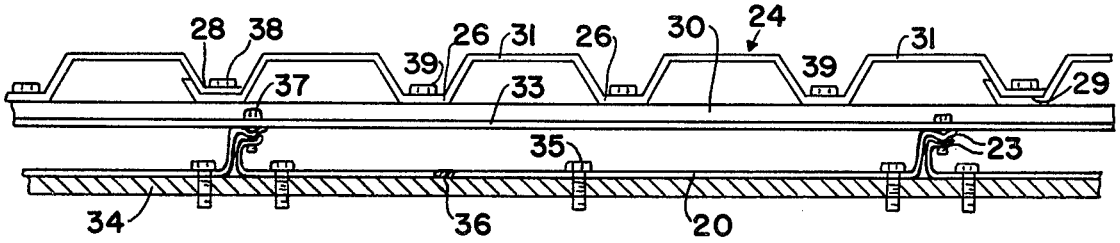
FIG. 4 is an end view, partly in section, showing a typical liner panel, subgirt and facing panel wall assembly.

Double-skin panels normally are assembled as shown in FIG. 4 wherein a building frame member 34 supports multiple liner panels 20 which are secured by fasteners 35 or by means of welds 36. Customarily all of the liner panels will be installed and thereafter subgirts 30 will be secured by means of fasteners 37 extending through the subgirt flanges 33 and the liner panel flanges 23.

Facing panels 24 are joined to the subgirts 30 by means of fasteners 38, 39. The fasteners 39 extend through a facing panel valley surface 26 into the crest surface 31 of the subgirt 30. Fasteners 38 extend through the lapped lateral valley surfaces 28, 29 of adjoining liner panels 24 and into the crest surface 31 of the subgirt 30. In a typical wall of the type shown in FIG. 4, thermal insulation material is installed in the space between the liner panel 20 and the subgirt 30.

Figure 5:
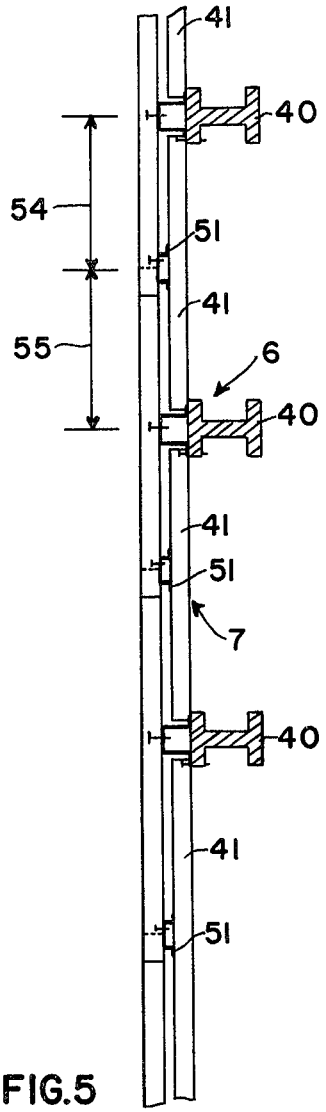
FIG. 5 is a sectional view taken through a vertical section of a building wall construction of this invention.

The building wall of the present invention can be assembled as shown in FIG. 5 wherein the liner panels have a single-span coverage, or as shown in FIG. 9 wherein the liner panels have a double-span coverage.

Figure 14:
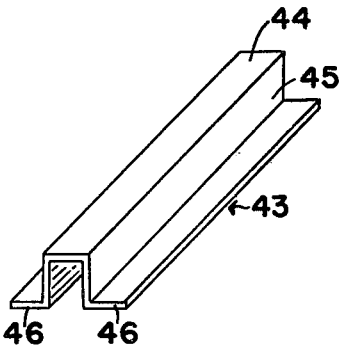
FIG. 14 is a perspective illustration of one embodiment of a support member.
Figure 15:
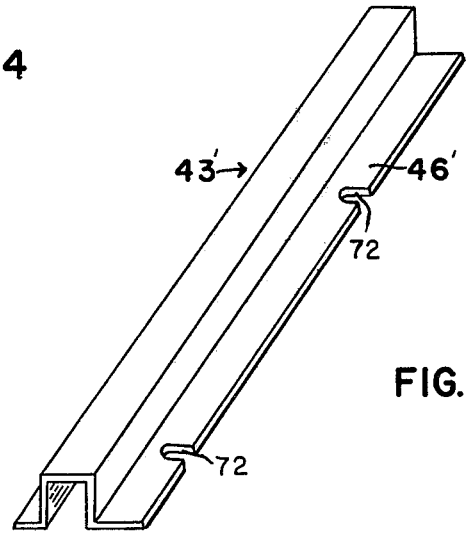
FIG. 15 is an enlarged perspective view of an alternative embodiment of a continuous support member.

Referring to FIG. 5, a typical building outer wall includes a plurality of building horizontal framing members 40 which may be beams, girders or subgirts of a building frame. Liner panels 41 span the distance between adjacent building framing members 40. The liner panels 41 are connected at their upper ends as shown in the enlarged view, FIG. 6, wherein the building framing member 40 has an outward face 42 to which is secured a continuous or discontinuous support member 43 as shown in FIG. 14 (discontinuous) or FIG. 15 (continuous). The support member 43 includes a crest surface 44, essentially parallel webs 45 and coplanar outer flanges 46. The continuous support means 43' as shown in FIG. 15 includes spaced slots 72 in the outward flanges 46' for receiving web surfaces 22 of liner panels 41.

Figure 6:
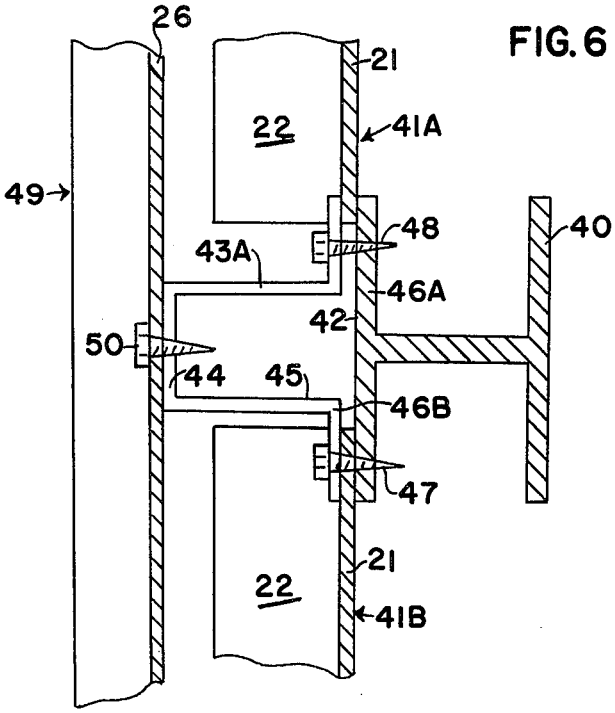
FIG. 6 is an enlarged sectional view of a joint detail indicated by the numeral 6 in FIG. 5.

It will be observed in FIG. 6 that the support member 43 secures the lower end of an upper liner panel 41A and secures the upper end of a lower liner panel 41B to the building framing member 40. It will be observed that the upper liner panel 41A is spaced apart from the lower liner panel 41B. The upper end of the liner panel 41B is positively secured to the building framing member 40 by means of a fastener 47 which extends through the outboard flange 46 and through the central surface 21 of the liner panel 41B. The lower end of the liner panel 41A is releasably secured to the building framing member 40 by means of a fastener 48 which clamps the central surface 21 of the liner panel 41A between the outward flange 46A and the outward face 42. Thus when the liner panel 41 is stressed inwardly or outwardly, its upper end 41B will be retained relative to the building framework members 40 and the lower end 41A will be free to slide upwardly and apart from its releasable restraint.

It will be observed that the support member 43 extends outboard from the outward face 42 by a distance which is greater than the length of the webs 22 of the liner panels 41.

Facing panels 49 are positively secured by means of fasteners 50 to the crest 44 of the support members 43. The fasteners 50 extend through valley surfaces 26 of the facing panels 49 and through the crest 44. Positive securing fasteners 50 are provided in the mid-region of each of the facing panels 49.

Figure 7:
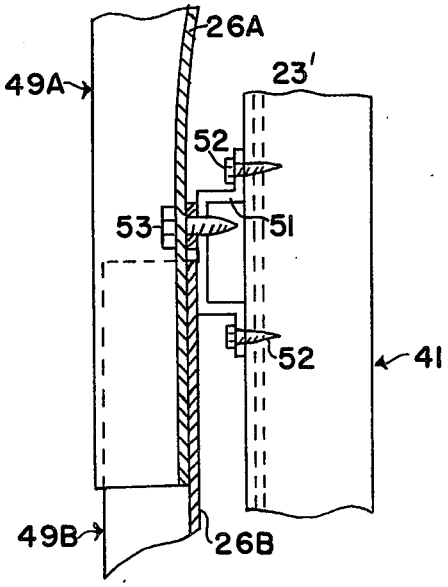
FIG. 7 is an enlarged cross-section detail of a joint indicated by the numeral 7 in FIG. 5.

The free ends of the facing panels 49 are secured to the building as shown in FIG. 7.

A subgirt 51 of the type (31) shown in FIGS. 3 and 4 is secured to the liner panel 41 by means of fasteners 52 which extend through subgirt flanges 51 into overlapped flanges 23' of the liner panel 41. The bottom end 49A of an upper facing panel and the upper end 49B of a lower facing panel are secured to the subgirt 51. A fastener 53 extends through a valley surface 26A of the upper facing panel and thence through the crest of the subgirt 51 whereby the bottom end of the upper facing panel 49A is positively secured to the liner panel 41. The upper end of the lower panel 49B has its valley surface 26B releasably secured between the valley surface 26A of the upper facing panel 49A and the crest of the subgirt 51 by means of the clamping achieved by the fastener 53. It will further be observed that the lower facing panel 49B is overlapped by the bottom of the upper facing panel 49A whereby the exterior surface of the building is weatherproof.

Thus the facing panel 49 is secured to the building framework in a positive manner by means of the mid-region connection (FIG. 6) and is positively connected at its lower end (FIG. 7) to the mid-region of the liner panel 41 through the subgirt 51 and is releasably secured at its upper end (FIG. 7) by means of the overlapping superposed facing panel and the clamping engagement provided at the subgirt 51.

Figure 8:
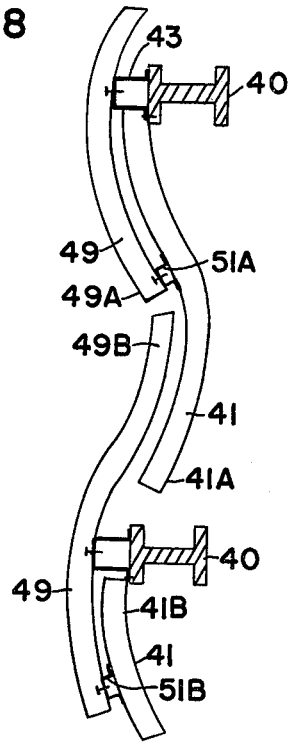
FIG. 8 is a schematic illustration showing the manner in which the building wall construction of FIG. 5 fails inwardly.

Referring to FIG. 8, the failure mode of the present wall construction is illustrated in an exaggerated fashion. The building framing members 40 of FIG. 8 correspond in detail to the construction shown in FIGS. 5, 6 and 7.

In the event of exterior stress applied to the building exceeding the preestablished threshold, it is a feature of the present wall construction that the wall will collapse inwardly by a combination of (a) the buckling of the facing panels 49 over the support members 43; and (b) the buckling of the liner panels 41 in the region of the subgirts 51.

As the facing panels 49 buckle, the upper ends 49B withdraw from their releasable engagement with the in-span subgirt 51A but are positively secured to the building framework through the support members 43 and are positively secured with the liner panel 41 by means of the positive connection to the subjacent subgirt 51B.

The failure of the liner panel 41 occurs by withdrawal of the bottom end 41A from engagement with the support member 43. It will be observed that the liner panel 41 continues to be positively secured to the building framework 40 by the positive connection of the upper end 41B to the support member 43.

It should be observed that the failure of the facing panels 49 occurs as a result of the separation of the upper end 49B from its releasable engagement. The upper end 49B in all embodiments is an overlapped edge.

Referring to the upper span of the building wall shown in FIG. 5, the numeral 54 indicates the distance between the upper building framing member 40 and the adjacent in-span subgirt 51. The numeral 55 indicates the distance between the lower building framing member 40 and the adjacent in-span subgirt 51. The ratio of the two distances 54:55 can be employed to establish with precision the failure stress required to collapse the present building wall construction. A minimum release load is achieved when the distance 54 equals the distance 55, i.e., the in-span subgirt 51 is midway between the framing members 40. If the in-span subgirt 51 is positioned upwardly or downwardly from the mid-distance, the release load will increase in a predictable manner.

It should further be observed that the spanning distances between the building framing members 40 can vary from level to level as shown in FIG. 5 wherein the two bottom spans are greater than the two upper spans.

TWO-SPAN CONSTRUCTION

Significant economies of materials and construction labor can be achieved by employing two-span liner wall constructions of the type shown in FIG. 9 wherein each of the liner panels 60 has an upper end 60A and a lower end 60B. The building framing members are identified in FIG. 9 as 40A and 40B. The liner panels 60 are positively secured at their mid-region to the alternate building framing members 40B as shown in FIG. 11. The liner panels 60 are releasably secured at each end 60A, 60B to the framing members 40A as shown in FIG. 10.

Referring to FIG. 10, a support member 43B of the type shown in FIG. 14 or 15 is secured to the outer face 42 of a framing member 40A by means of fasteners 61 which extend through the outward flanges 46C adjacent to the webs of the support member 43B. The outward flanges 46C releasably retain the central surfaces 21 of the ends of the liner panels 60A, 60B in a releasable engagement. A facing panel 62 is secured at its mid-region by means of a fastener 63 which penetrates a valley surface 26 and the crest of the support member 43B. Thus the facing panel 62 is positively secured to the building framing member 40A through the support member 43B.

The liner panels 60 are secured to the building framework in the mid-region at alternating framing members 40B as shown in FIG. 11. The liner panel may be secured directly to the outer face 42 of the framing member 40B by means of one or more fasteners 64 which penetrate the central surface 21 of the liner panels 60 and are secured in the framing member 40B. A subgirt 65, similar to the subgirt 31 of FIG. 3, is secured to the liner panel 60 by means of fasteners 66 which penetrate the overlapped flanges 23'' of the liner panels 60 and preferably extend through the central surface 21 into the framing member 40B. The subgirt 65 is an intermediate support member for the facing panels 62.

Facing panels 62 are secured by means of fasteners 67 which penetrate a valley surface 26 and the crest surface of the subgirt 65.

Thus, as shown in FIG. 11, the facing panel 62 is positively secured to the liner panel 60 and to the framing member 40B by means of the fastener 67, subgirt 65 and fasteners 66.

It is feasible that the fasteners 66 extend only through the outward flanges of the subgirt 65 into the overlapped flanges 23'' of the liner panel 60 whereby adequate positive retention for the facing panel 62 can be achieved.

Figure 12:
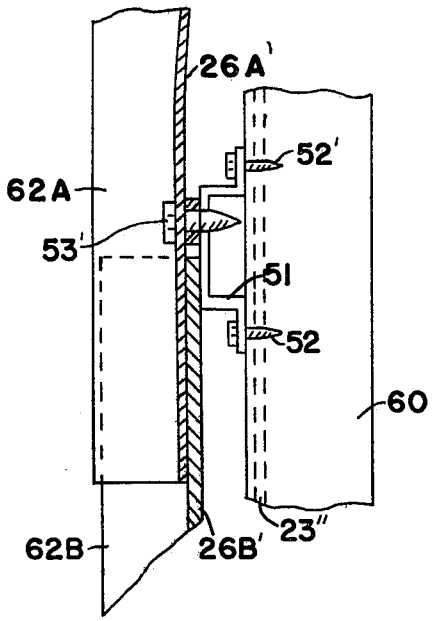
FIG. 12 is an enlarged cross-section detail of a joint indicated by the numeral 12 in FIG. 9.

The in-span connections between the liner panels 60 and the facing panels 62 are illustrated in FIG. 12 which is identical in appearance to FIG. 7. The corresponding elements of the double-span wall construction of FIG. 9 have been identified in FIG. 12. Their operation is identical to the operation of the in-span connection of FIG. 7. The numerals 62A, 62B in FIG. 12 identify an upper facing panel and an overlapped lower facing panel, respectively.

Figure 13:
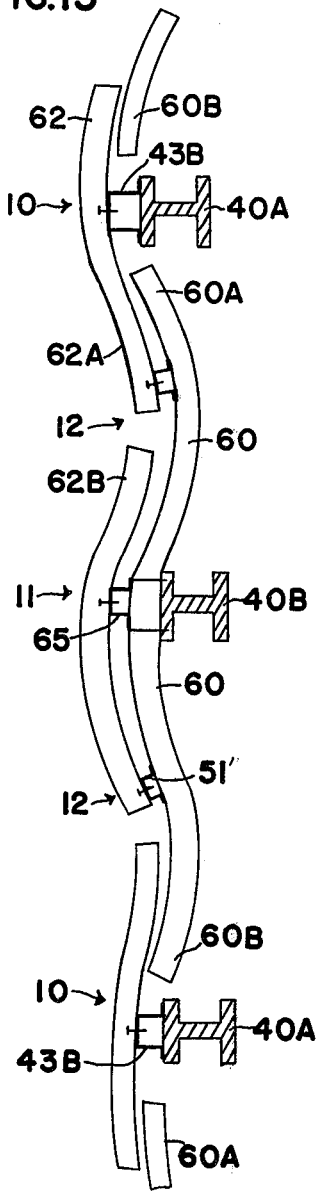
FIG. 13 is a schematic illustration showing the manner in which the building wall construction of FIG. 9 fails inwardly.

The double-span wall construction of FIG. 9 fails in the exaggerated fashion illustrated in FIG. 13 wherein the liner panel 60, when stressed from outside the building, tends to buckle at the location of the in-span subgirts 51' with the result that the free ends of the liner panel 60A, 60B tend to pull away from their releasable engagement with the support member 43B. The liner panel 60 remains positively secured to the building intermediate framing member 40B.

The facing panels 62 similarly withdraw at their upper ends 62B from the releasable engagement with the in-span subgirts 51' and buckle inwardly. The facing panels 62 remain positively secured to the building intermediate frame member 40B through the subgirt 65 as shown in FIG. 11. The facing panels 62 also remain positively secured at their lower ends 62A to the liner panel 60 through the positive connection with the in-span subgirt 51' as shown in FIG. 12.

Summarizing the sequence illustrated in FIG. 13, the facing panels 62 fail as a result of buckling over a frame member 40A or 40B. The liner panels 60 fail within each span as a result of liner panel buckling over an intermediate frame member 40B and buckling at the in-span subgirt 51'. As the failure proceeds, the facing panels 62 separate completely from the in-span subgirts 51' as the subgirt fasteners 53' and perhaps fasteners 52' are pulled from their fastening sites. In final failure, the liner panels 60 are wrapped about the intermediate framing members 40B and the facing panels 62 are wrapped about each of the framing members 40A, 40B.

As in the case of the single-span wall construction, the failure threshold of the double-span wall construction of FIG. 9 can be predicted with precision by carefully adjusting the distances 68, 69 and 70, 71. The distance 68 is between the framing member 40A and the adjacent in-span subgirt 51'. The distance 69 is between the intermediate framing member 40B and the same in-span subgirt 51'. The distance 70 is between the intermediate framing member 40B and the adjacent in-span subgirt 51'. The distance 71 is between the framing member 40A and the adjacent in-span subgirt 51'.

SUMMARY

The wall panel construction of the present invention includes liner panels which are positively secured to a building framework and are releasably secured within every span of the building framework. The facing panels similarly are positively secured in every span of the building framework and releasably secured in every span of the building framework. The performance reliability and predictability of the panel wall construction is excellent, i.e., the inward failure and outward failure loads can be calculated with precision. The present design accommodates the precise calculation of failure loads because the mode of failure, i.e., liner panel buckling and facing panel buckling is the controlling feature in the collapse of the walls.

I claim:

1. A building wall construction comprising:

a building framework including a first frame member and spaced therefrom a second frame member, said first frame member and said second frame member being adjacent to each other;

a liner panel spanning the distance between said frame members;

confinement means releasably retaining one liner panel end to said first frame member;

fastening means positively securing said liner panel to said second frame member;

outboard support means connected to each of said frame members and extending beyond said liner panel;

subgirt means secured to the mid-region of said liner panels;

a facing panel positively secured at its mid-region to said outboard support means;

fastening means positively securing one end of said facing panel to said subgirt means; confinement means releasably retaining the other end of said facing panel.

2. A building wall construction comprising:

a building framework including spaced apart first and second frame members and an intermediate frame member, the said first frame member and the said intermediate frame member being adjacent to each other, the said second frame member and the said intermediate frame member being adjacent to each other;

a first liner panel spanning the distance between said first frame member and said second frame member;

fastening means positively securing said liner panel to said intermediate frame member;

confinement means releasably retaining one end of said liner panel to said first frame member; confinement means releasably retaining the other end of said liner panel to said second frame member;

a first support member secured to said first frame member a second support member, secured to said second frame member, an intermediate subgirt member secured to said intermediate frame member, each of said support members extending beyond said liner panel;

first subgirt means secured to said liner panel between said first frame member and said intermediate frame member; second subgirt means secured to said liner panel between said intermediate frame member and said second frame member;

a first facing panel secured at its mid-region to the intermediate support member;

fastening means positively securing said first facing panel to said first subgirt;

confinement means releasably securing said first facing panel to said second subgirt means.

3. A building wall construction according to claim 1 or claim 2 wherein said frame members are generally horizontal and said facing panels are applied with the bottom end of one facing panel overlapping the top end of the subjacent one of said facing panels.

4. A building wall construction according to claim 1 or claim 2 wherein said frame members are generally horizontal and said liner panels have a generally flat surface engaged with said frame members; outboard webs generally perpendicular to said flat surface along each vertical side of each liner panel and flanges extended from at least one of said outboard webs, generally parallel to said flat surface, wherein the bottom edge of one liner panel is spaced apart from the top edge of the subjacent liner panel.

* * * * *